US005938866A

United States Patent [19]

Andersson et al.

[11] Patent Number: 5,938,866

[45] Date of Patent: Aug. 17, 1999

[54] METHOD AND AN APPARATUS FOR THE TREATMENT OF COMPONENTS BY A GAS MIXTURE

[75] Inventors: Göran Andersson, Nynäshamn; Ante Brunskog, Stockholm; Tore Eriksson, Ákersberga; Torsten Holm; Torgny Wingbro, both of Lidingö, all of Sweden

[73] Assignee: AGA Aktiebolag, Lidingo, Sweden

[21] Appl. No.: 08/973,650

[22] PCT Filed: Jun. 5, 1996

[86] PCT No.: PCT/SE96/00743

§ 371 Date: Mar. 25, 1998

§ 102(e) Date: Mar. 25, 1998

[87] PCT Pub. No.: WO97/00974

PCT Pub. Date: Jan. 9, 1997

[30] Foreign Application Priority Data

Jun. 22, 1995 [SE] Sweden ..... 9502278

[51] Int. Cl.[6] ..... C21D 9/00

[52] U.S. Cl. ..... 148/633; 148/625; 148/626; 266/251; 266/254

[58] Field of Search ..... 148/625, 626, 148/633; 266/251, 254; 96/372

[56] References Cited

U.S. PATENT DOCUMENTS 5,158,625 10/1992 Lhote et al. .

FOREIGN PATENT DOCUMENTS 313889 5/1989 European Pat. Off. .
451050 10/1991 European Pat. Off. .

*Primary Examiner*—Deborah Yee
*Attorney, Agent, or Firm*—Pearne, Gordon, McCoy & Granger LLP

[57] ABSTRACT

An apparatus for the treatment of components by means of a gas mixture, comprising mainly a first light gas and minor amounts of a second gas being heavier than the first gas, has a treatment chamber (10) in which the treatment occurs and a concentration, and purification device (19, 29, 30) in which the gas mixture is concentrated and purified to increase the concentration of the first gas. The treatment chamber (10) comprises an outlet member (19) provided in an upper part of the treatment chamber (10) and means (14, 15) being arranged to move the gas mixture upwardly and out through the outlet member (19). Said means may comprise an inlet member (14) provided in a lower part of the treatment chamber (10) and arranged to supply additional gas and to admit a laminar inward flow of said additional gas.

27 Claims, 1 Drawing Sheet

METHOD AND AN APPARATUS FOR THE TREATMENT OF COMPONENTS BY A GAS MIXTURE

TECHNICAL FIELD OF THE INVENTION AND PRIOR ART

The present invention concerns a method for the treatment of components by means of a gas mixture comprising mainly a first light gas and in a minor amount a second gas being heavier than the first gas, said method comprising a first step in which the gas mixture is utilized for the treatment of the components in a treatment chamber and a second step in which the gas mixture is subjected to a concentration and purification process in which the concentration of the First gas is increased, the gas mixture after the treatment in the treatment chamber being discharged for the supply thereof to the purification step. Furthermore, the present invention concerns an apparatus for the treatment of components by means of a gas mixture comprising mainly a first light gas and, in a minor amount, a second gas being heavier than the first gas, said apparatus comprising a treatment chamber, being arranged to allow the treatment of the components by means of the gas mixture, and a concentration and purification device being arranged to concentrate and purify the gas mixture to increase the concentration of the first gas.

It has been known for a long time, when hardening steel articles and components after heat treatment, to cool these rapidly by means of a fluid, i.e. oil. However, such a cooling may give rise to deformations of the articles and stresses in the material, because certain parts are cooled more rapidly than others. Furthermore, such a cooling requires a subsequent purification of the articles, and the use of oil may cause environmental problems. To solve these problems it has been suggested that the articles should be cooled by means of a gas. Such a gas cooling has as well the advantage of improving the possibility to control the cooling process.

U.S. Pat. No. 5, 158, 625 discloses a hardening device in which articles to be hardened are introduced in a furnace. After heating of the articles to a desired hardening temperature, they are cooled by means of helium at an absolute pressure of 2,5 bar. The helium is circulated in the furnace by a fan and is cooled by a heat exchanger. When the cooling has been finished, the contaminated helium is transported from the furnace to a buffer tank by means of a vacuum pump, so that a vacuum is obtained in the furnace. Then, the contaminated helium is transported by a compressor to a purification apparatus, comprising a filter for the removal of oil impurities and a purification member for the removal of water and oxygen from the helium. The thus purified helium is subsequently brought back to a second buffer tank and may from there be supplied to the furnace and thus be recirculated. The purification member is not described more closely in U.S. Pat. No. 5,158,625. The vacuum pumping of the furnace after the cooling has been performed results in a relatively large rest amount of helium in the furnace, since a complete vacuum may not be reached under practical conditions. Thus, this amount of helium is lost. Furthermore, vacuum pumping is time-consuming, requiring a relatively long cycle time for each batch to be treated.

SUMMARY OF THE INVENTION

The object of the present invention is to improve, when performing a treatment with gas, the possibilities to separate and recirculate the gases involved in the treatment.

Said object is attained by the initially mentioned method characterized in that said discharge comprises moving the gas mixture upwardly and out through an outlet member provided in an upper part of the treatment chamber by introducing additional gas, being heavier than the first gas, from below in the treatment chamber. Thereby, in the first place the lighter first gas will leave the treatment chamber and a first separation of the two gases is achieved. Advantageously, the additional gas is constituted of the second gas. Since the second gas is heavier than the first gas, it will not reach the outlet member but instead force the first gas upwards towards and out through this member. According to an embodiment, the additional second gas is introduced through a bottom surface of the treatment chamber as laminar inward flow into the treatment chamber. In this manner, it is effectively guaranteed that the first gas and the second gas introduced from below are not being mixed with each other. Advantageously, the laminar inward flow enters at essentially the total bottom surface of the treatment chamber.

According to an embodiment of the invention, the supply of the gas mixture to the concentration and purification step is performed by supplying the gas mixture, by means of a first overpressure, to a first purification column at a lower part thereof, which column comprises a receiving medium and in which essentially the second gas is received by the receiving medium and consecuently is separated from the first gas, and in that essentially the first gas is discharged from the first purification column at an upper part thereof. By such a purification column the fact is utilized that the first gas is lighter than the second gas so that the first gas not received by the receiving medium will be transported quickly through the purification column and thereafter it may in a comfortable way be recovered for later use in. the treatment process.

According to an embodiment, the supply of the gas mixture to the first purification column occurs until the second gas fills the first purification column to a predetermined first level. Since the first overpressure prevails in the first purification column, the release of the second gas may consequently be achieved by a lowering of the pressure, so that the second gas will force or move the lighter first gas upwardly and out through the upper outlet member of the first purification column. Then, and when the second gas has risen to such a second level that the second gas preferably fills up the first purification column totally and the first gas consequently has been discharged from the first purification column, the second gas may be evacuated from the first purification column through the lower part, e.g. by being connected to a vacuum tank. It is, in such a way, possible to recover the second gas.

According to a further embodiment, the first gas discharged is transferred to a container in which the first overpressure essentially prevails during the supply of the gas mixture to the first purification column. Furthermore, the first gas discharged and being present between the first and second level may be transported to this container through a second purification column comprising a receiving medium. In such a way, all of the first gas present in the process has been supplied to the container and may be recycled in the process. Thereby, the pressure in the container may be sensed and if it is below the first overpressure additional first gas is supplied from an external source through the second purification column. By transporting this addition of the first gas through the second purification column, the external source does not need to be of the absolutely highest quality but a certain degree of impurities of the first gas supplied may be tolerated.

According to an advantageous embodiment, the receiving medium comprises an adsorbing material, preferably zeolite. Furthermore, the first gas is Preferably helium and the second gas contains essentially nitrogen.

The object is also achieved by the initially mentioned apparatus characterized in that the treatment chamber comprises an outlet member provided in an upper part of the treatment chamber, and that the apparatus has means arranged to move the gas mixture upwards and out through the outlet member and comprises an inlet member provided in a lower part of the treatment chamber and arranged to supply additional gas being heavier than the first gas.

Preferable modes of the construction according to the invention are described in claims 18 to 27.

BRIEF DESCRIPTION OF THE DRAWING

The present invention will now be explained more closely referring to an embodiment disclosed in the annexed figure schematically showing an apparatus for hardening of metal articles.

DETAILED DESCRIPTION OF EMBODIMENTS

Figure 1:
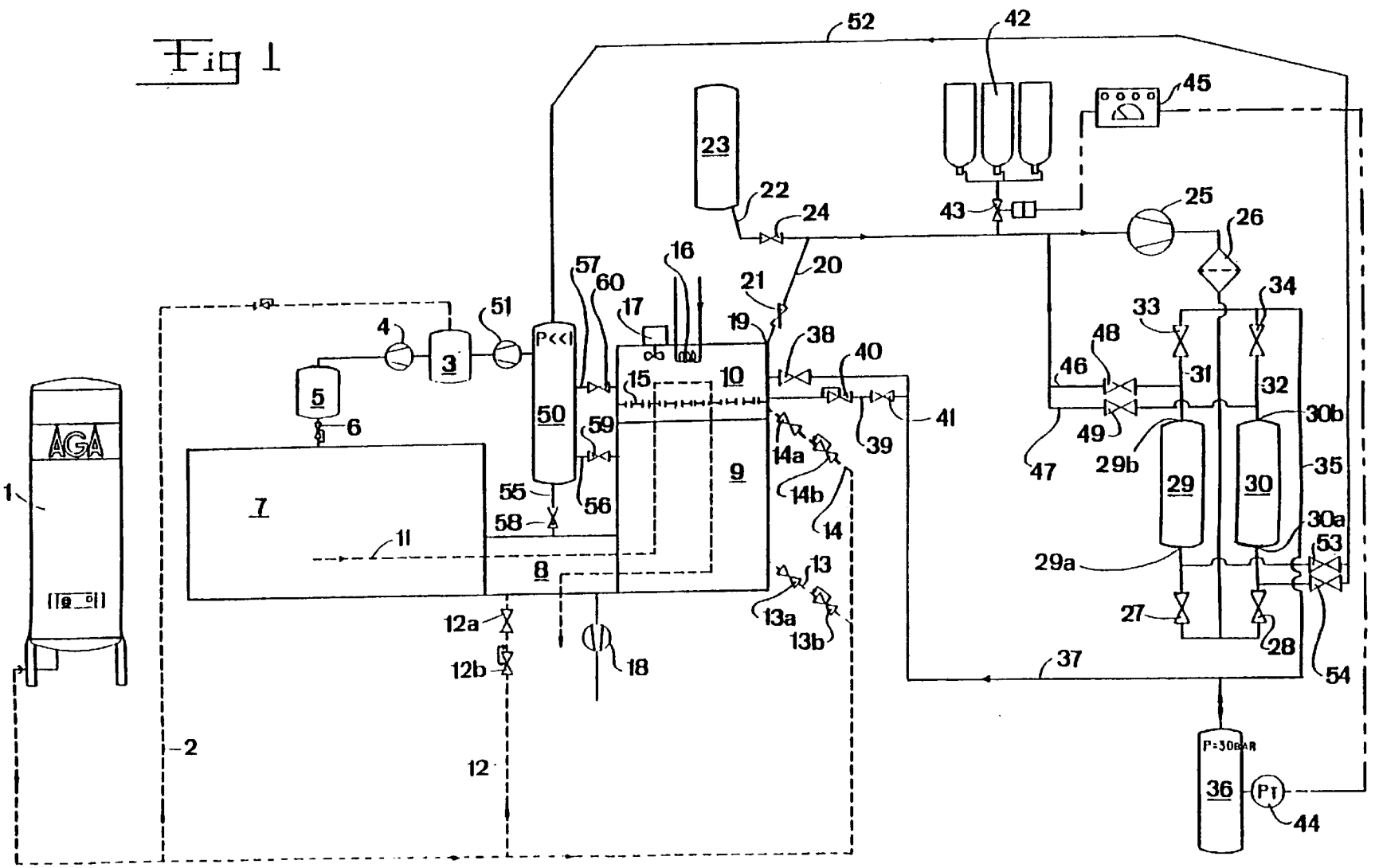

The figure shows a tank 1 filled with nitrogen. From the tank 1 the nitrogen is transferred through a conduit 2 to a storage container 3 where the nitrogen is stored under a pressure of approximately 1 bar. From the storage container 3, the nitrogen is transferred by a compressor 4 to an additional storage container 5 where the nitrogen is stored under a pressure of approximately 10 bar. By means of this high pressure and a control valve 6, the nitrogen is supplied to a hardening furnace 7, into which metal articles to be hardened are introduced. The hardening furnace 7 comprises conventional equipment not shown for heating of the metal articles to a desired temperature and furthermore means not shown for the supply of other gases desired for the heating process. The hardening furnace 7 is, via a closing device not shown, connected to a closed chamber 8 which in turn is connected to a transport chamber 9 via a closing device not shown. Above the transport chamber 9 there is a cooling chamber 10 and therebetween a closing device not shown is arranged, so that the cooling chamber 10 may be completely closed against the transport chamber 9. In the example shown, the volume of the closed chamber 8 is approximately 0,5 $m^3$, the volume of the transport chamber 9 is approximately 5 $m^3$ and the volume of the cooling chamber 10 is approximately 1,8 $m^3$. From the hardening furnace 7 extends a schematically indicated transport device 11 through the closed chamber 8, the transport chamber 9, the cooling chamber 10, back to the transport chamber 9, the closed chamber 8 and out of the closed chamber 8 through a door device not shown. By means of this transport device 11 the metal articles being heated in the hardening furnace 7 may be transported to the cooling chamber 10 and then out of the apparatus. Furthermore, for the supply of nitrogen the nitrogen tank 1 is connected to the closed chamber 8 via a conduit 12, to the transport chamber 9 via a conduit 13 and to the cooling chamber 10 via a conduit 14. Each of these three conduits 12, 13, 14 comprises a closing valve 12*a*, 13*a*, 14*a* and a control valve 12*b*, 13*b* and 14*b*.

A sintered mat 15 is provided in the lower part of the cooling chamber 10. The sintered mat 15 covers essentially the total bottom surface of the cooling chamber 10. The sintered mat 15 functions in such a way that nitrogen supplied to the cooling chamber 10 via the conduit 14 having its orifice beneath the sintered mat 15, will Flow in laminarly and evenly distributed over the whole cooling chamber 10. The nitrogen flowing inwardly consequently performs a laminar motion being vertically upwardly directed. It is also possible to use other flow devices than a sintered mat 15. It is e.g. possible to use a panel provided with nozzles or openings. Furthermore, a heat exchanger 16 is provided in the cooling chamber 10 and carries a cooling medium, e.g. water, from a cooling device not shown. Furthermore, a fan member 17 is provided in the cooling chamber 10 to circulate the gas present in the cooling chamber 10. Moreover, the closed chamber 8 comprises an outlet with a pump 18, by which the closed chamber 8 may be evacuated.

An outlet member 19 is provided in the upper part of the cooling chamber 10, e.g. in the form of an opening in an upper limiting wall of the cooling chamber 10. From the outlet member 19 a conduit 20 extends which comprises a valve 21. Another conduit 22 is connected to the conduit 20 and connects the conduit 20 to a buffer tank 23 having a volume of apnroximately 5 $m^3$. On the conduit 22, a valve 24 is provided. Furthermore, the conduit 20 is connected to a compressor 25 followed by an oil filter 26. After the oil filter 26 the conduit 20 is divided into two branches, each provided with a closing valve 27, 28 and leading to an identical purification column 29, 30. Each purification column 29, 30 has an elongated shape extending in a vertical direction and comprises an inlet member 29*a*, 30*a* provided in its lower part and an outlet member 29*b*, 30*b* provided in its upper part. each purification column 29, 30 is filled with a gas adsorbing material which in the example shown is zeolite binding nitrogen but not helium. From each of the outlet members 29*b*, 30*b* an outlet conduit 31, 32 extends which via a respective closing valve 33, 34 connects to an outlet conduit 35. The outlet conduit 35 leads to a pressure container 36 arranged to accommodate helium at a pressure of approximately 30 bar. From the pressure container 36 a supply conduit 37 extends via a valve 38 back to the cooling chamber 10. Parallel with the valve 38 there is a control conduit 39, comprising a control valve 40 and a closing valve 41. Furthermore, there is a helium source in the form of three gas containers connected to the conduit 20 via a control valve 43. The control valve 43 is controlled by an electronic control equipment 45 in response to the pressure sensed by a pressure sensor 44 in the pressure container 36. Furthermore, there are two connection conduits 46, 47 each connecting one of the outlet conduits 31, 32 to the conduit 20 upstream the compressor 25. Each of the connection conduits 46, 47 is provided with a closing valve 48, 49.

Furthermore, there is a vacuum tank 50, in which a very low pressure is maintained by means of a vacuum pump 51. The pressure side of the pump 51 is connected to the storage container 3. The vacuum tank 50 is via a conduit 52 and two parallel closing valves 53, 54 connected to the inlet members 29*a*, 30*a* of the purification columns 29, 30. Furthermore, the vacuum tank 50 is via conduits 55, 56, 57 connected to the closed chamber 8, the transport chamber 9 and the cooling chamber 10, respectively. Each of the conduits 55, 56, 57 is provided with a closing valve 58, 59, 60.

The process for hardening and gas recovery will now be described more closely. Metal articles heated in the hardening furnace 7 are transported into the closed chamber 8 being subjected to a vacuum by means of the vacuum tank 50 via the conduit 55 by the opening of the valve 58. Thereby, gases possibly being harmful for the following cooling process will disappear. After refilling of the closed chamber 8 with nitrogen by the opening of the valves 12*a*, 12*b*, the metal articles are transported to the transport chamber 9 where the transport device 11 moves the articles to the cooling chamber 10 for gas cooling. When the metal articles have been transported into the cooling chamber 10 the closing device (not shown) between the cooling chamber 10 and the transport chamber 9 is closed, and thereafter the valve 60 opens to provide a vacuum in the cooling chamber 10 by means of the vacuum tank 50. This is done to evacuate as much as possible of the nitrogen and thus to minimize the level of contamination of the nitrogen in the cooling process and thus the necessary size of the purification columns 29, 30. Then, the valve 60 is closed and the valve 38 opens to fill the cooling chamber 10 with the helium from the pressure tank 36 and pressurize the chamber 10 to approximately 15 bar. After this pressure has been reached the cooling process starts. When this occurs, the valve 38 is closed and the pressure is maintained by the opening of the valve 41 and the operation of the control valve 40. The circulation in the cooling chamber 10 is maintained by the fan member 17 and the cooling by means of the heat exchanger 16. When the cooling process is finished the fan is slowed down, the valves 21, 24 open and the cooling chamber 10 is evacuated by the pressure equalisation between the cooling chamber 10 and the buffer tank 23. Thereby, in the first place, the helium will leave the cooling chamber 10 since the cooling chamber 10, before the helium was supplied, was emptied of a large part of the nitrogen and since helium is lighter than nitrogen. However, a certain rest amount of nitrogen will be discharged to the buffer tank 23, since the evacuation occurs relatively rapidly and there is not enough time for any real separation of the two gases due to the weight difference. When the pressure difference between the cooling chamber 10 and the buffer tank 23 has reached a desired level the valve 24 is closed, the compressor 25 continuing to suck gas from the cooling chamber 10. When the pressure in the cooling chamber 10 has decreased to approximately 1–2 bar the valve 14*a* opens, while the compressor continues to suck gas from the cooling chamber 10, which slowly is filled from below with approximately 2 $m^3$ of nitrogen through the sintered mat 15. Thereby, the nitrogen moves the remaining helium upwardly and out of the cooling chamber 10 through the outlet member 19 and then only neglectable rest amounts of helium remain. At that time the valve 21 is closed and the cooled metal articles are transported out of the cooling chamber 10, then being ready for the cooling of next batch of metal articles. The compressor 25 continues to evacuate the buffer tank 23 until a pressure of 1 bar has been reached. Then, also the valve 24 is closed. Thus, it is both during the evacuation by means of the buffer tank 23 and in particular during the following "lifting" of the remaining helium, essential that the outlet member 19 is arranged in the upper part of the cooling chamber 10 to enable the utilization of the smaller weight of the helium compared to the nitrogen. The upper limiting wall of the cooling chamber 10 may possibly be inclined or have a conical or pyramidal shape, the outlet member 19 being arranged at the highest point of location.

The purification process for the gas used during the cooling functions according to the following. The gas mixture from the cooling chamber 10 is pressurized by means of the compressor 25 to a pressure of approximately 30 bar and transported through the filter 26, protecting the subsequent purification columns 29, 30 against possible oil residues or the like from the compressor 25. The valves 28 and 34 are now closed whereas the valves 27 and 33 are open. Thus, the gas mixture will be supplied from below through the purification column 29, the nitrogen present in the gas mixture being adsorbed by the zeolite in the purification column 29, whereas the lighter helium passes through the purification column 29 and the zeolite, and is transported further via the valve 33 and the conduit 35 to the pressure tank 36. Thus, the pressure in the purification column 29 and the pressure tank 36 will be approximately 30 bar. When the cooling chamber 10 is emptied and the valve 21 is closed, the valves 27 and 33 are also closed. At this point, the nitrogen reaches a first level in the purification column 29. This level may be at about a third of the total height of the purification column 29. Now the valve 48 opens and since the compressor 25 is still working, the pressure in the purification column 29 will decrease, the nitrogen being bound by the zeolite will be released and the helium being free and filling the purification column 29 from the first level will be lifted out by the nitrogen released and again pass the compressor 25, but is now transported via the open valves 28 and 34 and the other purification column 30 to the pressure tank 36. When the nitrogen fills all of the first purification column 29 and the pressure therein has decreased to approximately 5 bar the valve 48 is closed and instead the valve 53 opens, the purification column 29 being emptied of nitrogen by means of the vacuum tank 50. When the absolute pressure of the purification column 29 has decreased to approximately 0,3 bar, the column 29 is regenerated and ready for the next cycle. As being evident, the second purification column 30 is not necessary for the functioning of the purification process, but by means thereof the time of the cycle may be shortened by leading a gas mixture to be purified into the purification column 30 at the same time as the purification column 29 still is regenerated. Consequently, by means of this regeneration no nitrogen is released to the atmosphere, but all of it is transported to the vacuum tank 50 from which it may be reused in the process.

As the valve 48 is closed the system has exhausted all its possibilities to recycle more helium. Then, the pressure in the pressure tank 36 is sensed by means of the pressure sensor 44 giving a signal to the control equipment 45 if the pressure in the pressure tank 36 is below 30 bar. If that is the case the valve 43 is open to replace the helium that has disappeared. The thus supplied helium is pressurized by the compressor 25 and further transported to the pressure tank 36 via the valve 28, the purification column 30 and the valve 34. As the pressure sensor 44 senses that the desired pressure level has been reached, the valve 43 is closed again.

The vacuum system of the apparatus is constructed in the following way. The vacuum tank 50 is continuously emptied by the vacuum pump 51. The gas, essentially nitrogen, being sucked out is transported to the storage container 3 which is a source for the compressor 4. From this the gas mixture is transported to the storage container 5 which is a source for the nitrogen supply to the hardening furnace 7. The valves 13*a* and 59 may be used for the cleaning of the atmosphere in the transport chamber 9. These may be open when required, e.g. every tenth cycle.

The invention is not limited to this embodiment shown. For instance, the invention may be used with other gases such as hydrogen or neon instead of helium and some other heavier inert gas instead of nitrogen, e.g. argon.

We claim:

1. A method for the treatment of components by means of a gas mixture comprising mainly a first light gas and a minor amount of a second gas being heavier than the first gas, said method comprising a first step in which the gas mixture is utilized for the treatment of the components in a treatment chamber, and a second step in which the gas mixture is subjected to a concentration and purification process in which the concentration of the first gas is increased, the gas mixture after the treatment in the treatment chamber being discharged for the supply thereof to the purification step, characterized in that said discharge comprises moving the gas mixture upwardly and out through an outlet member provided in an upper part of the treatment chamber by introducing additional gas, being heavier than the first gas, from below in the treatment chamber.

2. A method according to claim 1, characterized in that the additional gas is the second gas.

3. A method according to claim 2, characterized in that the additional second gas is introduced through a bottom surface of the treatment chamber as a laminar flow into the treatment chamber.

4. A method according to claim 3, characterized in that said laminar flow enters at essentially the total bottom surface of the treatment chamber.

5. A method according to any one of the claims 2 to 4, characterized in that the treatment in the treatment chamber is performed under pressure and that said discharge is initiated by connecting the treatment chamber to a lower pressure in order to attain a pressure equalization, resulting in a portion of the gas mixture leaving the treatment chamber.

6. A method according to claim 5, characterized in that the additional second gas is introduced from below after said discharge by pressure equalization.

7. A method according to any one of the preceding claims, characterized in that the supply of the gas mixture to the concentration and purification step is performed by supplying the gas mixture, by means of a first overpressure, to a first purification column at a lower part thereof, which column comprises a receiving medium and in which essentially the second gas is received by the receiving medium and consequently separated from the first gas, and in that essentially the first gas is discharged from the first purification column at an upper part thereof.

8. A method according to claim 7, characterized in that the supply of the gas mixture to the first purification column occurs until the second gas fills the first purification column to a predetermined first level.

9. A method according to claim 8, characterized in that the pressure in the first purification column is decreased from the first overpressure to a second lower overpressure when the second gas fills the first purification column to the predetermined first level, so that the second gas rises to a predetermined second upper level and the first gas being present between the first and second level is discharge from the first purification column at the upper part thereof.

10. Method according to claim 9, characterized in that the second gas is evacuated from the first purification column at the lower part, after the second gas has risen to the second level and the first gas has been discharged from the first purification column.

11. A method according to any one of claims 7 to 10, characterized in that the first gas discharged is transferred to a container in which the first overpressure substantially prevails during the supply of the gas mixture to the first purification column.

12. A method according to claim 11, characterized in that the first gas discharged and being present between the first and the second level is transported to the container through a second purification column comprising a receiving medium.

13. A method according to claim 11 or 12, characterized in that the pressure in the container is sensed and if it is below the first overpressure, additional first gas is supplied from an external source through the second purification column.

14. A method according to any one of the claims 7 to 13, characterized in that the receiving medium comprises an adsorbing material, preferably zeolite.

15. A method according to any one of the preceding claims, characterized in that the first gas is helium.

16. A method according to any one of the preceding claims, characterized in that the second gas essentially consists of nitrogen.

17. An apparatus for the treatment of components by means of a gas mixture comprising mainly a first light gas and, in minor amounts a second gas being heavier than the first gas, said apparatus comprising a treatment chamber (10), being arranged to allow the treatment of the components by means of the gas mixture, and a concentration and purification device (19, 29, 30) being arranged to concentrate and purify the gas mixture to increase the concentration of the first gas, characterized in that the treatment chamber (10) comprises an outlet member (19) provided in an upper part of the treatment chamber (10), and that the apparatus has means (14, 15) arranged to move the gas mixture upwards and out through the outlet member (19) and comprises an inlet member (14) provided in a lower part of the treatment chamber (10) and arranged to supply additional gas being heavier than the first gas.

18. An apparatus according to claim 17, characterized in that the additional gas is the second gas.

19. An apparatus according to claim 17 or 18, characterized in that said means (14, 15) comprises a member (15) being arranged to allow a laminar inward flow of the additional gas.

20. An apparatus according to claim 19, characterized in that said flow member (15) is arranged over essentially the total bottom surface of the treatment chamber to enable the laminar inward flow from the total bottom surface of the treatment chamber.

21. An apparatus according to claim 19 or 20, characterized in that said flow member (15) comprises a sintered mat.

22. An apparatus according to any one of the claims 17 to 21, characterized in that the treatment is performed under a high pressure and that the outlet member (19) is connected a low pressure tank (23) arranged to be connected to the treatment chamber (10) for a first discharge of the gas mixture from the treatment chamber (10) by means of pressure equalization.

23. An apparatus according to any one of the claims 17 to 22, characterized in that the purification device comprises a first purification column (29) comprising a medium receiving essentially the second gas, an inlet member **(29*a*) provided in a lower part thereof and an outlet member (29*b*) provided in an upper part thereof, and means arranged to supply the gas mixture to the purification column (29) via the inlet member (29*a*) by means of a first overpressure and to transport essentially the first gas from the purification column (29) via the outlet member (29*b*) of the purification column (29)**.

24. An apparatus according to claim 23, characterized by a supply channel (20) leading to the inlet member **(29*a*), a discharge channel (31, 35) leading from the outlet member (29*b*) of the purification column (29), a first valve member (27, 28) provided at the inlet member (29*a*) and having two positions, a first guiding the gas mixture to the first purification column (29) and a second guiding the gas mixture to by-pass the first purification column (29) via a connection channel (30, 32) to the discharge channel (35), a second valve member (33, 48) provided at the outlet member (29*b*) of the purification column (29) and having two positions, a first guiding the essentially first gas back to the first valve member (27, 28) via said supply means (25) and a second guiding the essentially first gas to the discharge channel (35)**.

25. An apparatus according to claim 24, characterized in that the valve members (27, 28, 33, 48) are arranged in such a manner that when the first valve member is its first position, the second valve member is its second position.

26. An apparatus according to claim 24 or 25, characterized in that a second purification column (30) comprising a medium receiving essentially the second gas is provided on the connection channel (32).

27. An apparatus according to any one of the claims 23 to 26, characterized in that the receiving medium comprises an adsorbing material, preferably zeolite.

* * * * *

UNITED STATES PATENT AND TRADEMARK OFFICE

CERTIFICATE OF CORRECTION

PATENT NO. : 5,938,866

DATED : August 17, 1999

INVENTOR(S) : Andersson et al.

It is certified that error appears in the above-identified patent and that said Letters Patent is hereby corrected as shown below:

Column 1, Line 16, delete "First" and insert --first--.

Column 2, Line 30, delete "gas so" and insert --gas, so--.

Column 2, Line 33, delete "in." and insert --in--.

Column 3, Line 3, delete "Preferably" and insert --preferably--.

Column 3, Line 66, delete "Flow" and insert --flow--.

Column 8, Line 37, Claim 22, after "connected", insert --to--.

Signed and Sealed this

Eleventh Day of January, 2000

*Attest:*

*Attesting Officer*

Q. TODD DICKINSON

*Acting Commissioner of Patents and Trademarks*